US009321232B2

(12) United States Patent
Lee

(10) Patent No.: US 9,321,232 B2
(45) Date of Patent: Apr. 26, 2016

(54) APPARATUS AND METHOD FOR MANUFACTURING COMPRESSED LUMP OF METAL SCRAP

(75) Inventor: Tae Ho Lee, Busan (KR)

(73) Assignee: DAEJONG INDUSTRY CO., LTD., Gyeonggi-Do (KR)

( * ) Notice: Subject to any disclaimer, the term of this patent is extended or adjusted under 35 U.S.C. 154(b) by 815 days.

(21) Appl. No.: 13/512,428

(22) PCT Filed: Jan. 30, 2012

(86) PCT No.: PCT/KR2012/000657
§ 371 (c)(1),
(2), (4) Date: May 29, 2012

(87) PCT Pub. No.: WO2012/138047
PCT Pub. Date: Oct. 11, 2012

(65) Prior Publication Data

US 2012/0266724 A1 Oct. 25, 2012

(30) Foreign Application Priority Data

Jan. 28, 2011 (KR) ..... 10-2011-000561

(51) Int. Cl.
*B30B 9/32* (2006.01)
*B30B 1/00* (2006.01)
*B30B 9/30* (2006.01)

(52) U.S. Cl.
CPC ..... *B30B 9/327* (2013.01); *B30B 9/3014* (2013.01); *B30B 9/3078* (2013.01); *B30B 9/32* (2013.01)

(58) Field of Classification Search
CPC ..... B30B 9/3078; B30B 9/326; B30B 9/327; B30B 9/328; B30B 9/3014; B30B 9/32; Y10S 100/906; C22B 1/248; B21J 5/08; B21J 5/10
USPC ..... 100/94, 95, 98 R, 98 A, 218, 232, 229 R, 100/240, 245, 246, 247, 255, 295, 901, 100/906; 29/403.2, 422; 425/406; 72/362, 72/370.27, 333; 75/770
See application file for complete search history.

(56) References Cited

U.S. PATENT DOCUMENTS

| | | | | | |
|---|---|---|---|---|---|
| 3,129,656 | A | * | 4/1964 | Judd | 100/98 R |
| 3,141,401 | A | * | 7/1964 | Lindemann et al. | 100/98 R |
| 3,371,599 | A | * | 3/1968 | Tezuka | 100/215 |
| 3,577,912 | A | * | 5/1971 | Busi | 100/218 |
| 3,791,289 | A | * | 2/1974 | Lamorte et al. | 100/179 |
| 4,230,037 | A | * | 10/1980 | Schmalz | 100/95 |
| 5,069,044 | A | * | 12/1991 | Holum et al. | 62/320 |
| 5,735,197 | A | * | 4/1998 | Kleine | 100/127 |
| 7,964,004 | B2 | * | 6/2011 | Koch et al. | 48/61 |

FOREIGN PATENT DOCUMENTS

| | | | | | |
|---|---|---|---|---|---|
| JP | 60018298 | A | * | 1/1985 | B30B 9/00 |

* cited by examiner

*Primary Examiner* — Jimmy T Nguyen
(74) *Attorney, Agent, or Firm* — Kramer Amado P.C.

(57) ABSTRACT

An apparatus and method for manufacturing a compressed lump of metal scrap that is capable of compressing various kinds of collected metal scrap into a standardized form so that the metal scrap can be directly introduced into a blast furnace. A through hole is formed in a compressed lump of metal scrap during manufacture of the compressed lump of metal scrap so that the compressed lump of metal scrap can be efficiently melted and the interior of the compressed lump of metal scrap can be observed.

17 Claims, 13 Drawing Sheets

PRIOR ART

APPARATUS AND METHOD FOR MANUFACTURING COMPRESSED LUMP OF METAL SCRAP

CROSS REFERENCE TO RELATED APPLICATION

This application claims priority to international patent application number PCT/KR2012/000657, entitled, "Apparatus for Manufacturing Metal Scrap Compression Material and Manufacturing Method thereof", filed on Jan. 30, 2012, and Korean Patent Application Number 10-2011-008561, filed on Jan. 28, 2011 the entire disclosures of which are hereby incorporated herein by reference in their entireties for all purposes.

BACKGROUND OF THE INVENTION

1. Field of the Invention

The present invention relates to an apparatus and method for manufacturing a compressed lump of metal scrap that is capable of compressing various kinds of collected metal scrap into a standardized form so that the metal scrap can be directly introduced into a blast furnace.

2. Description of the Related Art

As is generally known, various kinds of metal scrap, including materials dug from various production fields or used molds disposed from various production fields, reinforcing rods obtained from demolished buildings, and metal waste, such as scrapped vehicles, disused gas containers or cans obtained from various consumption fields, are collected, sorted, and melted to manufacture various kinds of steel materials, thereby reducing resources and energy used to manufacture steel materials and eventually protecting environment.

To this end, metal scrap is basically sorted according to kinds of the metal scrap and is compressed into a compressed lump of metal scrap which is formed and standardized so that the compressed lump of metal scrap can be directly introduced into a blast furnace of a steel mill, to which the compressed lump of metal scrap is supplied.

Such a compressed lump of metal scrap is generally configured so that the sum of the width, length, and height of the compressed lump of metal scrap is between 600 mm and 2100 mm. Also, metal scrap is compressed so that a compressed lump of metal scrap has the maximum length of less than 800 mm and a density of 0.15 or more.

In a conventional apparatus for manufacturing such a compressed lump of metal scrap, metal scrap, including ferrous metal scrap and nonferrous metal scrap, such as aluminum and copper, collected via various routes is sorted and compressed by a compression apparatus to form a compressed lump of metal scrap in the shape of a hexahedral body having a predetermined standard. A representative example of the apparatus for manufacturing the compressed lump of metal scrap is disclosed in Japanese Utility Model Publication No. S38-11798 entitled "Scrap press apparatus" (hereinafter, referred to as a 'cited invention').

The cited invention provides a scrap press apparatus configured to have a structure in which a slide type upper cover 1 is installed above a scrap molding chamber 2 having a press plate 5 and transverse press plates 20 provided at left and right sides thereof, a stationary cover unit 3 is installed above a material molding side of the scrap molding chamber 2, a lower cover 7, which can be freely opened and closed, to discharge a shaped product is installed under the material molding side of the scrap molding chamber 2, a shearing cutter 4 is installed at a contact portion between the stationary cover unit 3 and the slide type cover, and a shearing cutter 6 is installed above the press plate 5. In the cited invention, metal scrap is charged into the scrap molding chamber 2, the upper cover 1 is closed, and a primary cylinder 14 is driven to advance a piston 13. As a result, the press plate 5 primarily compresses metal scrap in the scrap molding chamber 2 into a form as indicated by a dotted line of FIG. 2. Subsequently, the opposite transverse press plates 20 are advanced to the middle of the scrap molding chamber 2 by pistons 22 of cylinders 21 to secondarily compress the primarily compressed metal scrap. After the metal scrap is secondarily compressed, a lower cover actuating cylinder 8 connected to the lower side of the lower cover 7 is driven to pull the middle of a link 10. As a result, the lower cover 7 is opened to the lower side, and therefore, a compressed lump 23 of metal scrap falls and is carried outside by a conveyor 18.

A required number of compressed lumps of metal scrap of a predetermined standard manufactured according to the cited invention with the above-stated construction are directly introduced into a blast furnace to manufacture various kinds of steel products. Consequently, a very efficient operation is possible.

On the other hand, such a compressed lump of metal scrap is obtained by compressing a large amount of metal scrap with high density so that the volume of the compressed lump of metal scrap is small. For this reason, the compressed lump of metal scrap has large thermal capacity, and therefore, it is necessary to heat the compressed lump of metal scrap for a long time using a large amount of energy so as to melt the compressed lump of metal scrap. Consequently, a large amount of energy is consumed in a melting process with the result that costs necessary to manufacture steel products are greatly increased. Also, a discharge amount of carbon is increased as a large amount of energy is consumed with the result that environment is polluted.

As a rule, metal scrap must be sorted according to ingredients of the metal scrap so that pure nonferrous metal scrap or pure ferrous metal scrap can be separately compressed to manufacture such a compressed lump of metal scrap. However, some thoughtless processors mix concrete, which is heavy, with metal scrap to manufacture a poor compressed lump of metal scrap. If such a poor compressed lump of metal scrap is introduced into a blast furnace, the blast furnace is contaminated by impurities. Enormous expense is needed to remove contaminants from the blast furnace, and, in addition, a production project is frustrated. As a result, steelmakers have difficulty in using a compressed lump of metal scrap.

SUMMARY OF THE INVENTION

Therefore, the present invention has been made in view of the above problems, and it is an object of the present invention to provide an apparatus and method for forming a through hole in a compressed lump of metal scrap during manufacture of the compressed lump of metal scrap so that the compressed lump of metal scrap can be efficiently melted and the interior of the compressed lump of metal scrap can be observed instead of drilling a finished compressed lump of metal scrap to form a through hole in the compressed lump of metal scrap as in the cited invention, thereby efficiently producing the compressed lump of metal scrap.

In accordance with the present invention, the above and other objects can be accomplished by the provision of an apparatus for manufacturing a compressed lump of metal scrap, including a primary compression cylinder installed at one side of a compression chamber, a primary press plate configured to be moved in a primary compression space by a piston of the primary compression cylinder, secondary compression cylinders installed at opposite sides of the compression chamber, secondary press plates configured to be moved in a secondary compression space by pistons of the respective secondary compression cylinders, a discharge plate disposed at the middle of the secondary compression space, and an opening and closing unit configured to open and close the discharge plate, wherein a direction in which compression is performed by the primary press plate is perpendicular to a direction in which compression is performed by the secondary press plate, and the apparatus further includes at least one core installed at the middle of the secondary compression space in an erected state so that the core is perpendicular to the direction in which compression is performed by the primary press plate and the direction in which compression is performed by the secondary press plate and a core cylinder for advancing and retreating the core to form at least one through hole, and a method of manufacturing a compressed lump of metal scrap using the apparatus for manufacturing the compressed lump of metal scrap.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

In one embodiment of the present invention, there is provided an apparatus for manufacturing a compressed lump of metal scrap configured to compress metal scrap by a primary press plate reciprocated in a primary compression space of a compression chamber, which is opened and closed by a cover cylinder so that metal scrap is charged into the compression chamber, by a primary compression cylinder and secondary press plates reciprocated in opposite sides of a secondary compression space of the compression chamber by secondary compression cylinders and to discharge the compressed lump of metal scrap through a discharge port, wherein a direction in which compression is performed by the primary press plate is perpendicular to a direction in which compression is performed by the secondary press plate, and the apparatus includes a core installed at the middle of the secondary compression space in an erected state so that the core is perpendicular to the direction in which compression is performed by the primary press plate and the direction in which compression is performed by the secondary press plate and a core cylinder for reciprocating the core.

Now, preferred embodiments of the present invention will be described in detail with reference to the accompanying drawings so that the present invention can be easily made by a person having ordinary skill in the art to which the present invention pertains.

Figure 1:
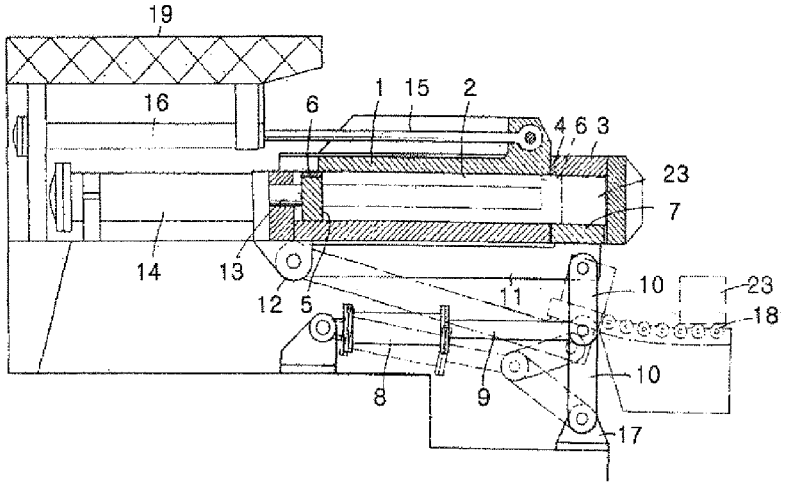
FIG. 1 is a longitudinal sectional view showing the construction of a cited invention.
Figure 2:
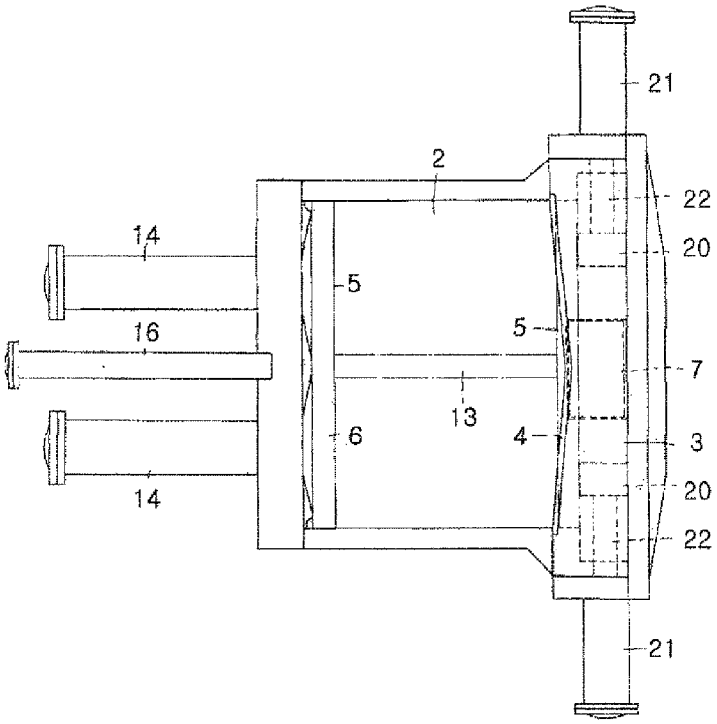
PRIOR ART FIG. 2
FIG. 2 is a plan view illustrating the construction of the cited invention.
Figure 3:
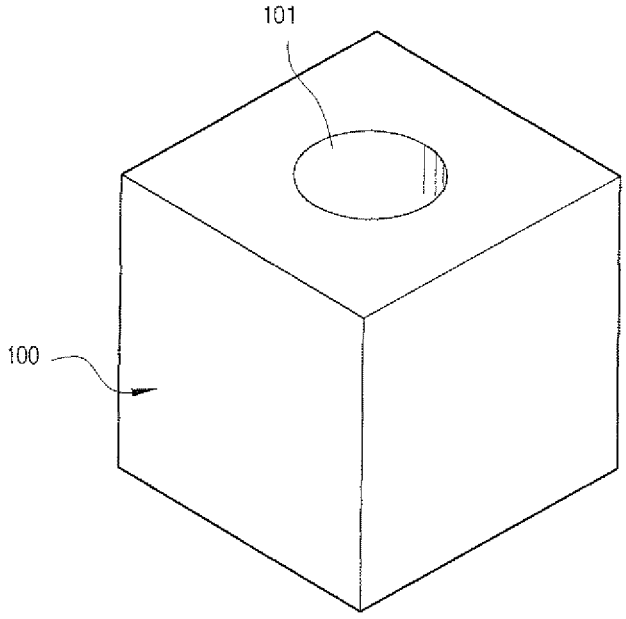
FIGS. 3 and 4 are perspective views showing a compressed lump of metal scrap according to the present invention.
Figure 4:
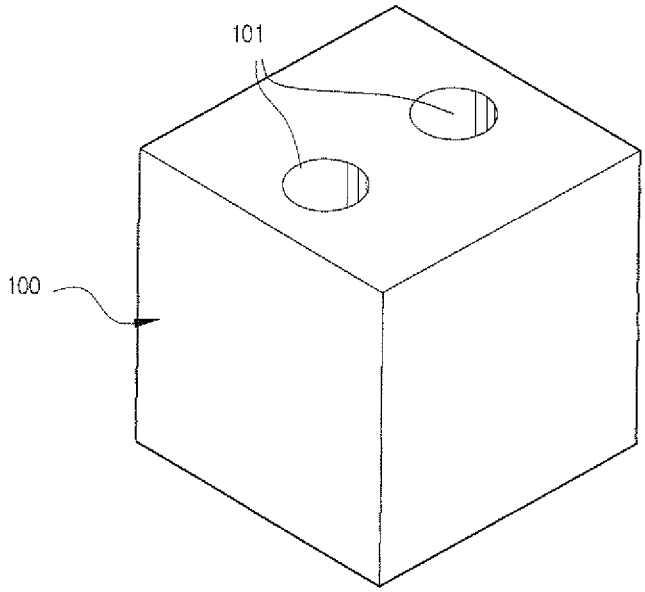

First, a compressed lump 100 of metal scrap according to the present invention is shown in FIGS. 3 and 4.

As shown in these drawings, the compressed lump 100 of metal scrap is formed into a hexahedral body having a predetermined width, length and height according to the present invention. At least one straight through hole 101 is formed in the compressed lump 100 of metal scrap so that the through hole 101 extends through the compressed lump 100 of metal scrap. When the compressed lump 100 of metal scrap is introduced into a blast furnace, therefore, hot air and molten metal can infiltrate into the compressed lump 100 of metal scrap through the through hole 101. Consequently, it is possible to melt the compressed lump 100 of metal scrap using a small amount of fuel.

Also, it is possible for an engineer to inspect the interior of the compressed lump 100 of metal scrap through the through hole 101 with the naked eye or using a camera before the compressed lump 100 of metal scrap is introduced into the blast furnace.

As shown in FIG. 4, it is possible to form two through holes 101. According to circumstances, it is possible to form three or more through holes 101, the diameter of which is small. The more through holes 101 the compressed lump 100 of metal scrap has, the easier the compressed lump 100 of metal scrap melts. However, it is necessary to additionally install a plurality of cores 201 and a plurality of core cylinders 200, which are operated in a state in which metal scrap is compressed under high pressure. For this reason, it may be most economical to form only one through hole 101 in consideration of manufacturing equipment costs. Hereinafter, therefore, the present invention will be described based on embodiments of the present invention that form one through hole 101.

Figure 5:
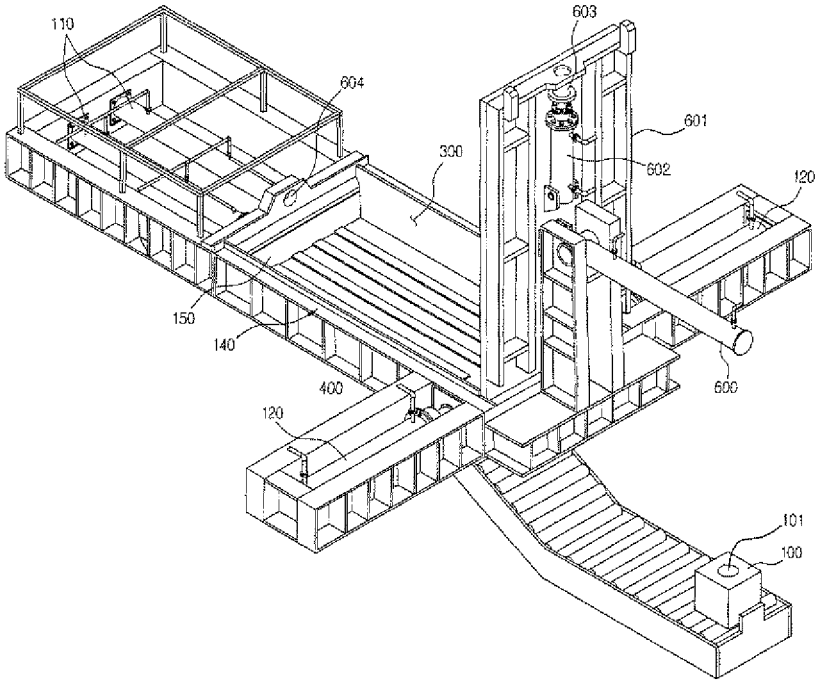
FIG. 5 is a perspective view showing overall construction of an apparatus for manufacturing a compressed lump of metal scrap according to the present invention when viewed from the rear of a cover.
Figure 6:
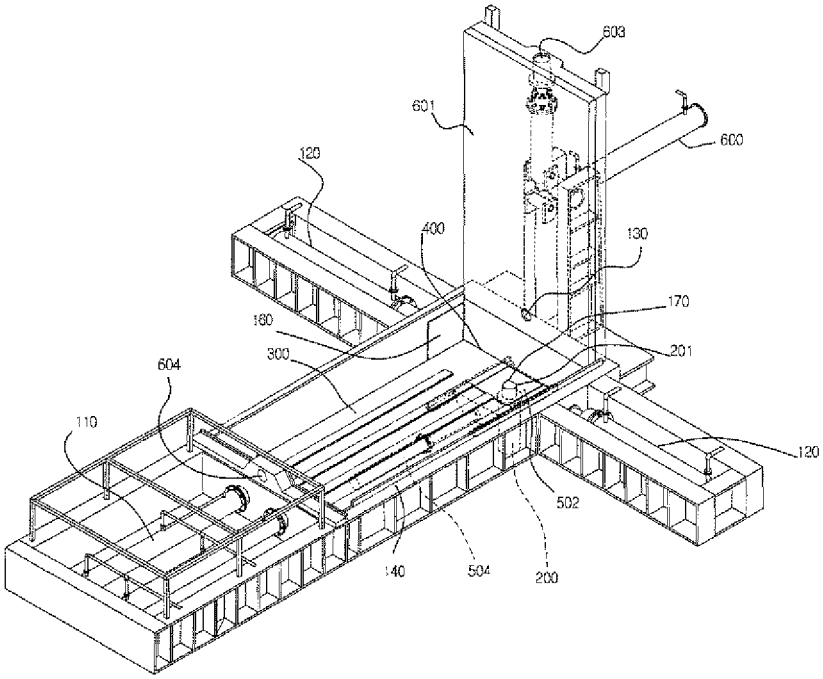
FIG. 6 is a perspective view showing an operation standby state in a compression chamber of the apparatus for manufacturing the compressed lump of metal scrap according to the present invention.

FIGS. 5 and 6 are perspective views showing the concrete structure of a manufacturing apparatus according to the present invention when viewed in two directions. As shown in these drawings, the manufacturing apparatus according to the present invention includes two primary compression cylinders 110, which are long. The primary compression cylinders 110 are provided to obtain force sufficient to primarily compress various forms of metal scrap, charged in a compression chamber 140, during movement of a primary press plate 150 in a primary compression space 300 of the compression chamber 140 from one side of the compression chamber 140. One, two or three primary compression cylinders 110 may be installed based on kinds and charge amount of metal scrap.

Also, secondary compression cylinders 120 are installed at opposite sides of a secondary compression space 400 of the compression chamber 140. A secondary press plate 160 is fixed to a piston of each of the secondary compression cylinders 120 so that the secondary press plate 160 can be advanced toward the middle of the secondary compression space 400.

Figure 7:
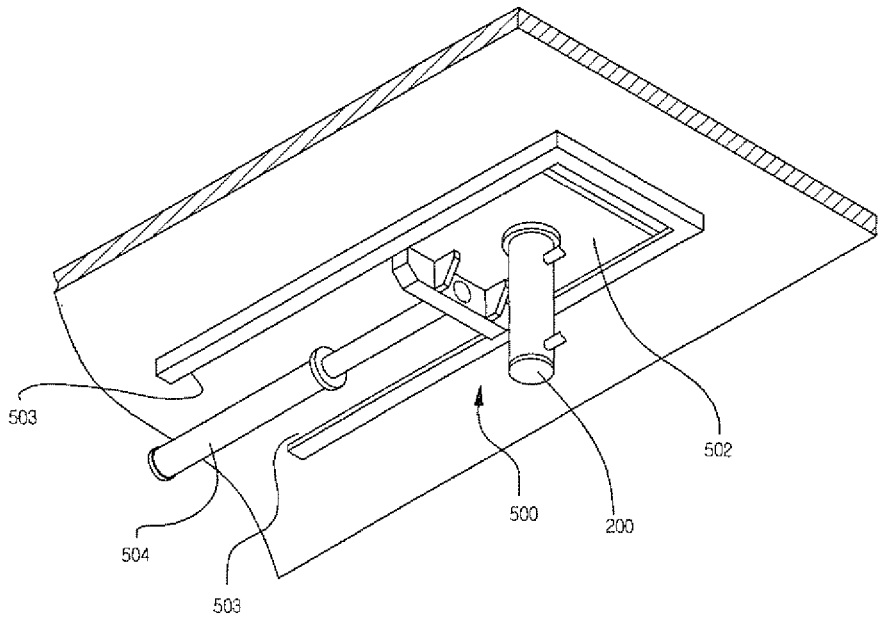
FIG. 7 is a bottom view showing an installation state of a core cylinder of the apparatus for manufacturing the compressed lump of metal scrap according to the present invention.

Also, the movement distance of the secondary press plate 160 installed at each side of the compression chamber 140 is the distance by which the secondary press plate 160 moves to the compressed lump 100 of metal scrap formed at the middle of the secondary compression space 400. Consequently, the stroke of the secondary press plate 160 is short, and therefore, the length of each secondary compression cylinder 120 and the length of the piston thereof are relatively short. Particularly, in the present invention, a core 201 configured to form a through hole 101 penetrating the middle of the compressed lump 100 of metal scrap and a core cylinder 200 to reciprocate the core 201 are installed in addition to the construction of the cited invention. The core 201 is installed perpendicularly to a primary press direction and a secondary press direction. At the same time, the core 201 is installed so as to be erected at the middle of the secondary compression space 400. In the embodiment of the present invention shown in FIGS. 5 and 6, the core cylinder 200, which advances and retreats the core 201, is installed under the middle of a discharge plate 502 as shown in FIG. 7. A tip 170 having incline planes is formed at the front end of the core 201. The tip 170 is engaged in a core tip receiving groove 130 of a cover 601 to prevent the core 201 from being deformed due to friction between the core 201 and the metal scrap or stress applied to the core 201, which is caused by deviation of compression force applied to the metal scrap during primary and secondary compression.

Also, the manufacturing apparatus according to the present invention further includes the core 201 and the discharge plate 502 installed at the middle of the secondary compression space 400 as described above and an opening and closing unit 500 to open and close the discharge plate 502.

The opening and closing unit 500 may include a hydraulic cylinder 504 and a piston in addition to the discharge plate 502. The opening and closing unit 500 may be configured so that the discharge plate 502, which is formed of a plate-shaped member having a thickness sufficient to bear pressure, is reciprocated along a guide groove 503 to open and close a discharge port 501. Alternatively, the discharge plate 502 may be opened and closed by the hydraulic cylinder 504 so as to open and close the discharge port 501.

In addition, in this embodiment of the present invention, the discharge plate 502, the core cylinder 200 and the core 201 are simultaneously reciprocated by the hydraulic cylinder 504 since the core cylinder is installed at the middle of the bottom of the discharge plate 502.

Also, in the present invention, the primary and secondary compression cylinders 110 and 120, the core cylinder 200, the hydraulic cylinder 504, a cover cylinder 600 and a locking cylinder 602 are used. Although not shown, a hydraulic pipe is connected to the pistons so that the pistons can be advanced or retreated according to directions in which hydraulic pressure is supplied, which is well known in the art to which the present invention pertains, and therefore, a description thereof will be omitted for the sake of convenience. An operation standby state of the manufacturing apparatus according to the present invention is shown in a side view of FIG. 8.

Figure 8:
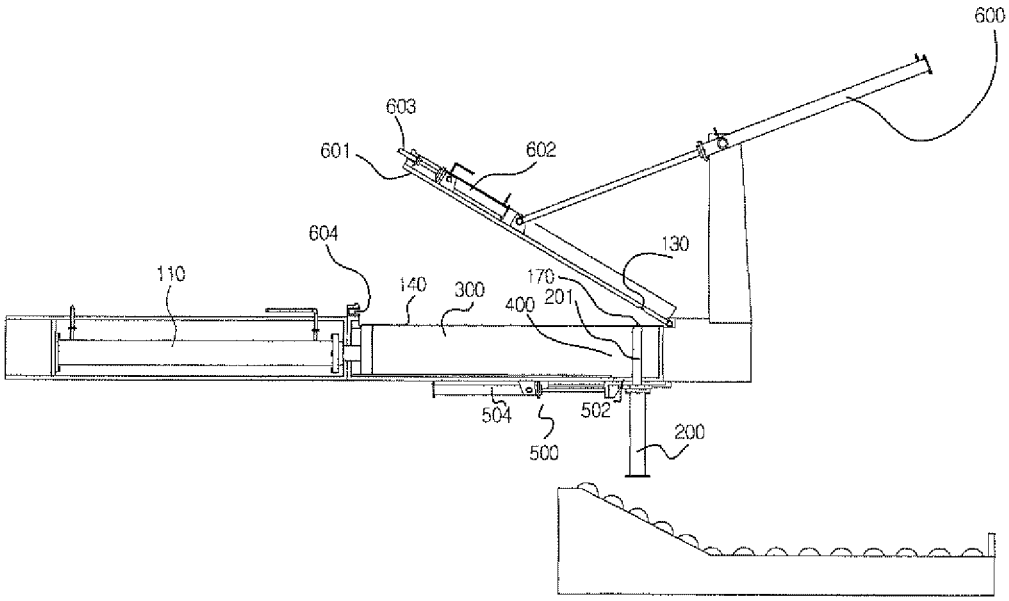
FIG. 8 is a side view showing a state in which a core of the core cylinder is erected vertically before metal scrap is charged into the compression chamber of the apparatus for manufacturing the compressed lump of metal scrap according to the present invention.

As shown in FIG. 8, the core 201 is erected by the core cylinder 200 before charging of metal scrap, and the cover 601 is opened by the cover cylinder 600. In this state, metal scrap is charged into the compression chamber 140. After the primary compression space 300 and the secondary compression space 400 are filled with the metal scrap, the cover cylinder 600 is driven to close the cover 601.

Figure 9:
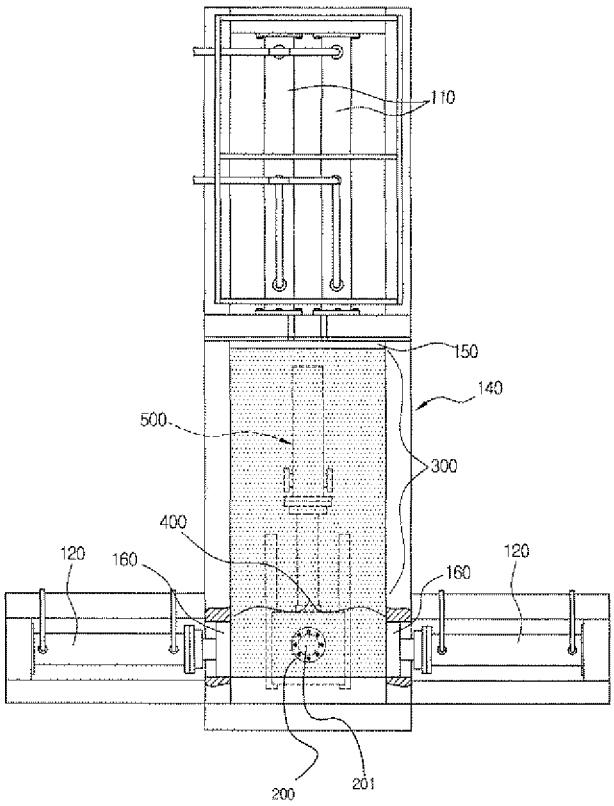
FIG. 9 is a plan view showing a state in which charging of metal scrap into the compression chamber of the apparatus for manufacturing the compressed lump of metal scrap according to the present invention shown in FIG. 8 has been completed.

A state in which primary compression is ready as described above is shown in a plan view of FIG. 9. As shown in FIG. 9, the core 201 is advanced by the core cylinder 200, the primary and secondary press plates 150 and 160 are located at the same position as walls of the compression chamber 140 in a state in which the primary and secondary compression cylinders 110 and 120 are in an operation standby mode, and the hydraulic cylinder 504 is in a state in which the discharge port 510 is closed by the discharge plate 502.

Figure 10:
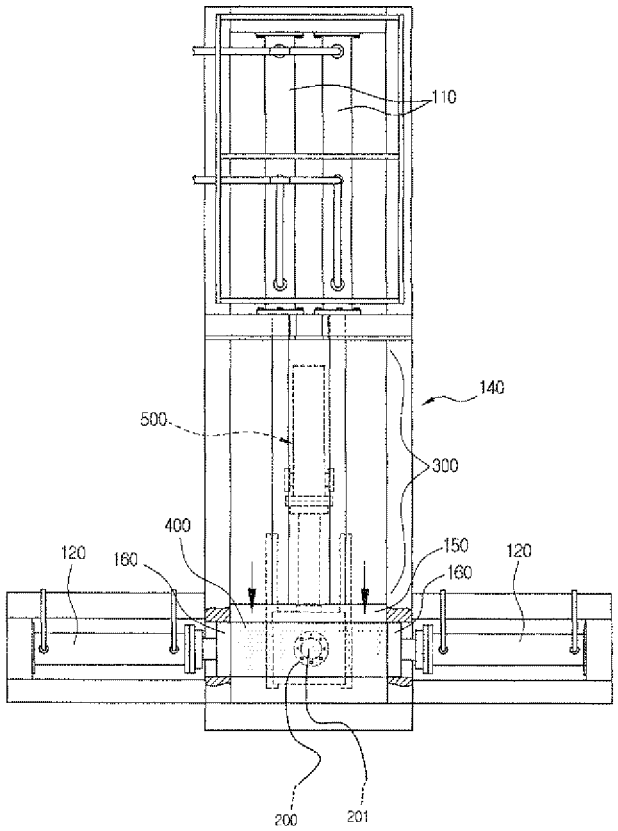
FIG. 10 is a plan view showing a state in which a primary press plate has been advanced in the apparatus for manufacturing the compressed lump of metal scrap according to the present invention.

In the manufacturing apparatus with the above-stated construction according to the present invention, first, the primary press plate 150 is moved to the end of the primary compression space 300 by the pistons of the primary compression cylinders 110 as shown in FIG. 10. Consequently, metal scrap, which has been primarily compressed in the compression chamber 140, is placed in the secondary compression space 400 in a standby state. The metal scrap wraps the corn 201 while moving to the secondary compression space 400 during primary compression. In this state, the tip 170 of the core positioned at the middle of the secondary compression space 400 is engaged in the core tip receiving groove 130 formed at the cover 601 according to the present invention, thereby preventing the core 201 from being pushed or deformed by the metal scrap moving to the secondary compression space 400 during primary compression.

Consequently, the metal scrap in the compression chamber 140 is clustered into the secondary compression space 400 while the density of the metal scrap is primarily increased by the primary press plate 150, and the metal scrap clustered into the secondary compression space 400 is primarily compressed. At the same time, the core 201 is located at a portion of the compression chamber at which a through hole 101 is to be formed in a compressed lump of metal scrap. When the secondary press plates 160 start to compress the metal scrap in the secondary compression space 400 according to operation of the secondary compression cylinders 120 in a state in which the core 201 of the core cylinder 200 extends as described above, the metal scrap starts to be compressed at density higher than that of the primary compression as described above. When the secondary press plates 160 are advanced to a position corresponding to the final dimensions of a compressed lump 100 of metal scrap, the advancement of the secondary press plates 160 is stopped by the secondary compression cylinders 120. This state is shown in a plan view of FIG. 11 and a side view of FIG. 12. In this state, a through hole 101 is formed in the compressed lump 100 of metal scrap at the portion of the compression chamber at which the core 201 is located so that the through hole 201 surrounds the core 21 as shown in an enlarged sectional view of FIG. 12.

Figure 13:
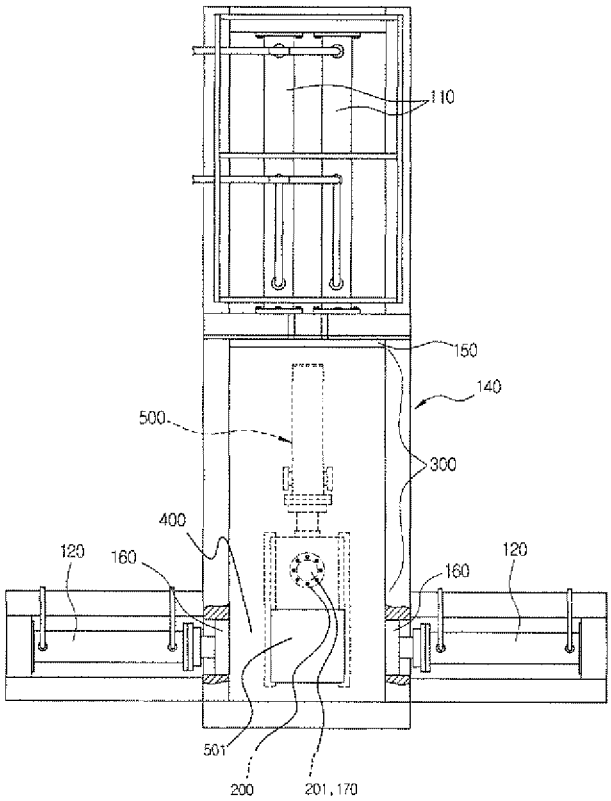
FIG. 13 is a plan view showing a state in which the compressed lump of metal scrap is dropped in the apparatus for manufacturing the compressed lump of metal scrap according to the present invention.
Figure 14:
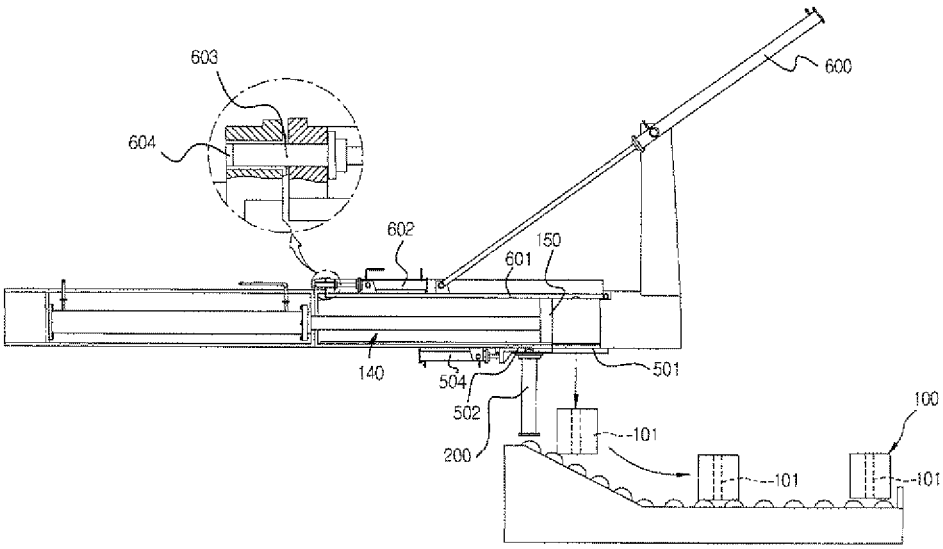
FIG. 14 is a side view showing a state in which the compressed lump of metal scrap is dropped and discharged from the apparatus for manufacturing the compressed lump of metal scrap according to the present invention.

In this state, however, the compressed lump 100 of metal scrap cannot be discharged. According to the present invention, therefore, it is necessary to retreat the core 201 so that the tip 170 of the core 201 is placed at a lower position than the surface of the discharge plate 502 and the compression chamber 140 as shown in FIGS. 13 and 14.

To this end, the core cylinder 200 is driven. As a result, the core 201 is retreated, and then the primary compression cylinders 110 and the secondary compression cylinders 120 are retreated to their original positions. In addition, the hydraulic cylinder 504 of the opening and closing unit 500 is driven to reciprocate the discharge plate 502 along the guide groove 503 so that the discharge port 501 is opened with the result that the compressed lump 100 of metal scrap falls through the discharge port 501 and is carried outside by a conveyor.

Subsequently, the hydraulic cylinder 504 of the opening and closing unit 500 is driven to move the discharge plate 502 so that the discharge plate 502 closes the discharge port 501. The core 201 is moved upward by the core cylinder 200, and a piston 603 of the locking cylinder 602 is separated from a locking hole 604, and then the cover cylinder 600 is driven to lift the cover 601 so that the manufacturing apparatus is in state as shown in FIG. 8. Subsequently, metal scrap is charged into the compression chamber, the primary compression cylinders 110 are driven to resume primary compression with the respect to the metal scrap through the primary press plate 150. In this way, the process of manufacturing the compressed lump 100 of metal scrap is continuously repeated.

Figure 15:
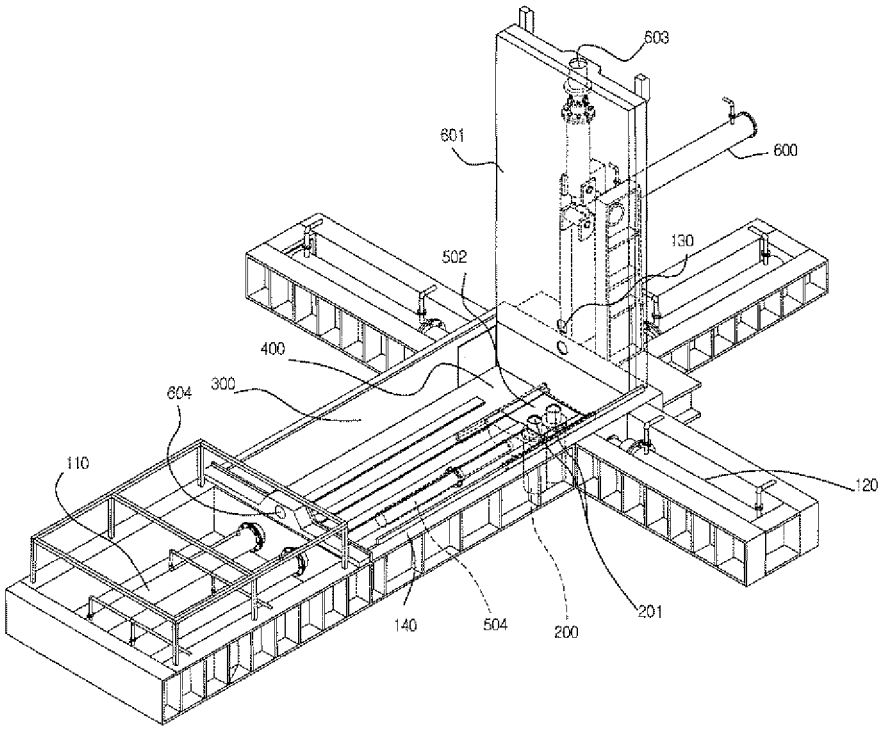
FIG. 15 is a perspective view showing an embodiment for forming two through holes in the compressed lump of metal scrap in the apparatus for manufacturing the compressed lump of metal scrap according to the present invention.

In addition, according to the present invention, as shown in FIG. 15, two core cylinders 200 are installed at the discharge plate 502 so that two cores 201 can be advanced and retreated, and tips 170 formed at the upper ends of the two cores 201 are configured to be engaged in two core tip receiving grooves 130 formed at the bottom of the cover 601

Figure 11:
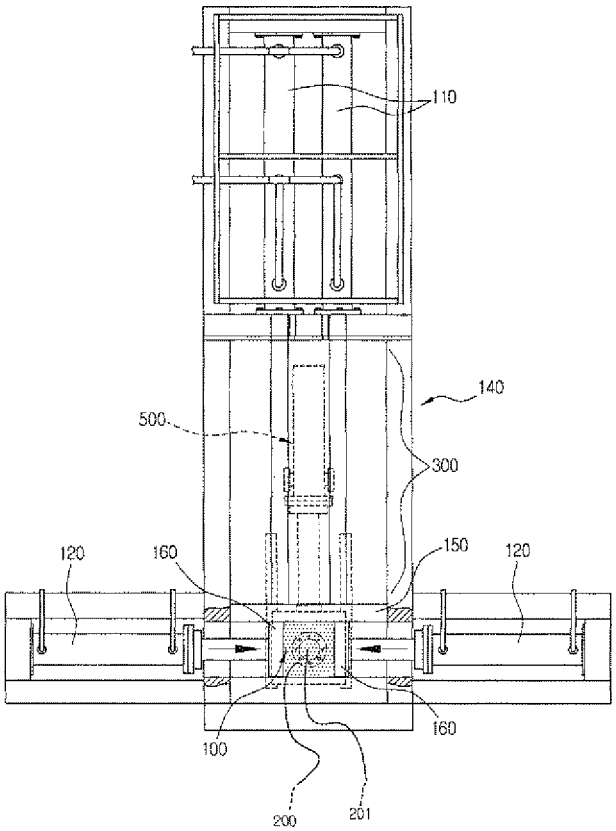
FIG. 11 is a plan view showing a state in which, after the primary press plate had been advanced, secondary press plates have been advanced to a secondary compression space by secondary compression cylinders in the apparatus for manufacturing the compressed lump of metal scrap according to the present invention.
Figure 16:
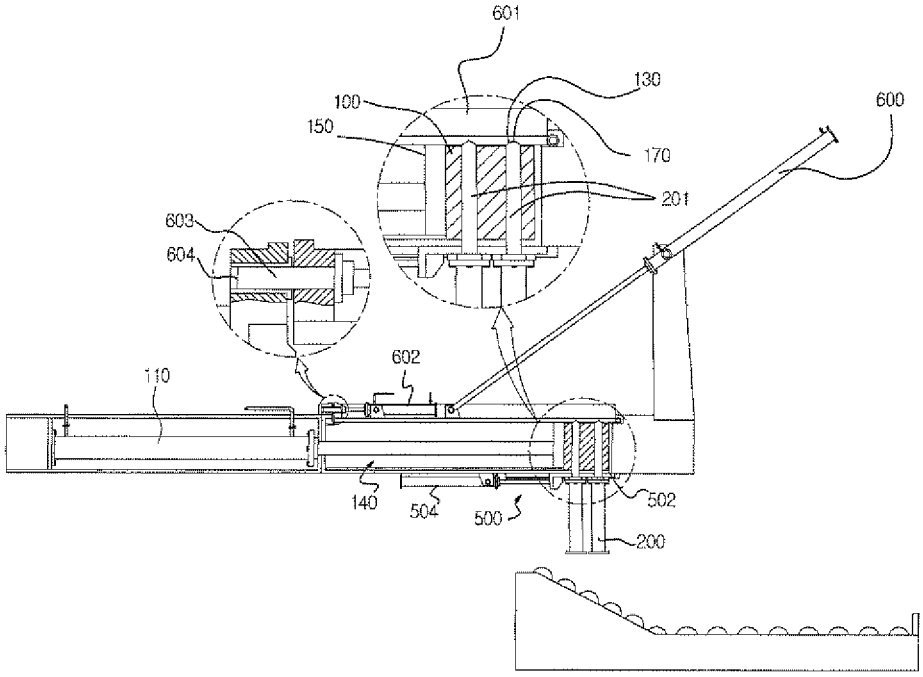
FIG. 16 is a longitudinal sectional view of a principal part of the apparatus for manufacturing the compressed lump of metal scrap according to the present invention showing a state in which cores of the core cylinders are positioned in two through holes formed in a compressed lump of metal scrap as the result of primary and secondary compression.
Figure 17:
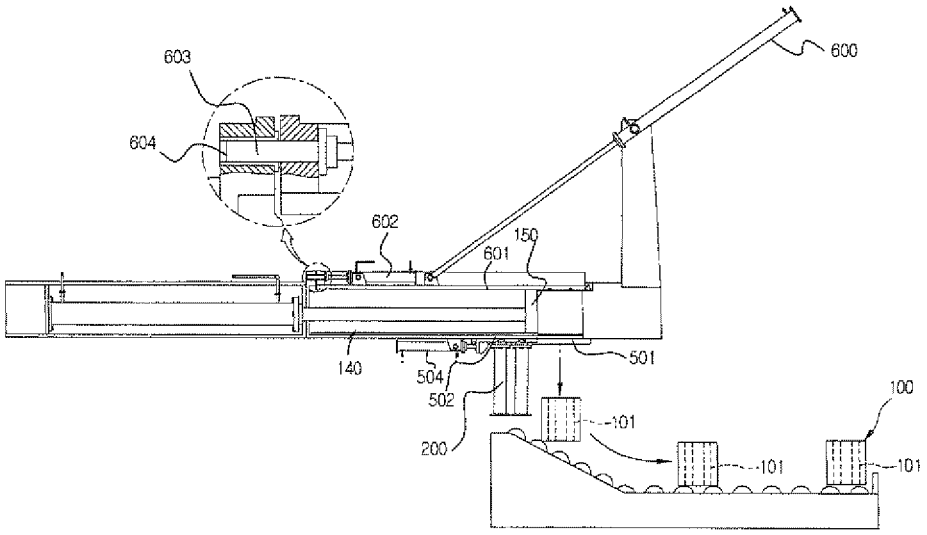
FIG. 17 is a side view showing discharge of a compressed lump of metal scrap, two through holes of which have been formed by the cores of the core cylinders during primary and secondary compression.

In this state, metal scrap is charged into the compression chamber 140, and primary and secondary compression is carried out through the process shown in FIGS. 9 to 11. As a result, a compressed lump 100 of metal scrap is finally formed in a state in which two through holes 101 are formed in the compressed lump 100 of metal scrap at the portions of the compression chamber at which the two cores 201 are located at the middle of the secondary compression space 400 as shown in FIG. 16. Subsequently, the hydraulic cylinder 504 of the opening and closing unit 500 is driven to retreat the discharge plate 502 along the guide groove 503 so that the discharge port 501 is opened. As a result, as shown in FIG. 17, the compressed lump 100 of metal scrap falls and is discharged through the discharge port 501.

Figure 18:
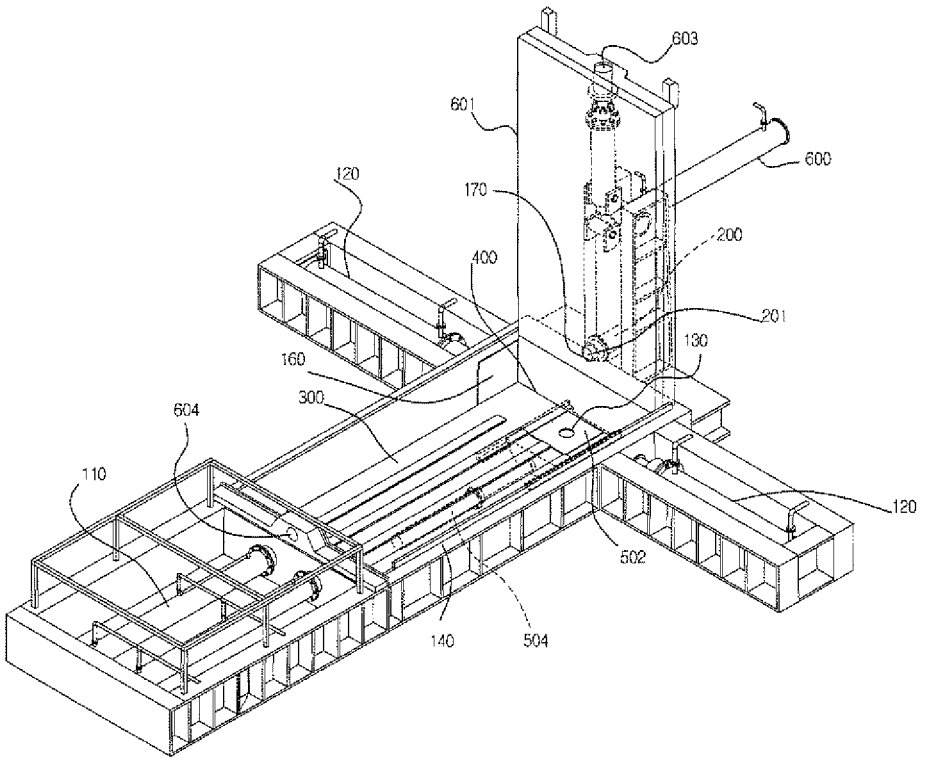
FIG. 18 is a perspective view showing an embodiment in which a core cylinder is installed at a cover in the apparatus for manufacturing the compressed lump of metal scrap according to the present invention.

Meanwhile, the core 201 and the core cylinder 200 may be installed at other positions different from the discharge plate 502. A concrete example thereof is shown in FIG. 18. As shown in FIG. 18, the core 201 and the core cylinder 200 are installed at the cover 601 instead of the discharge plate 502. In this embodiment, it is necessary to locate the core tip receiving groove 130 at the middle of the discharge plate 502.

In this embodiment, as shown in FIG. 18, the cover 601 is opened to open the compression chamber 140. In this state, metal scrap is charged into the compression chamber 140, the cover 601 is closed, and primary and secondary compression is carried out through the process shown in FIGS. 9 to 11. In this embodiment, in order to easily achieve downward movement of the core 201 of the core cylinder 200 installed at the cover 610 moving downward to the secondary compression space 400 during charge of the metal scrap, it is necessary for the core 201, which will form a through hole 101 in the compressed lump 100 of metal scrap, to be placed at a predetermined position before compression so that the metal scrap is not placed at the middle of the secondary compression space 400.

In this embodiment, metal scrap is charged, the cover 601 is closed, and the core cylinder 200 is driven to move the core 201 downward. At this time, the tip 170 of the core 201 is engaged in the core tip receiving groove 130 formed at the middle of the discharge plate 502 with the result that the core 201 is stably fixed.

Figure 19:
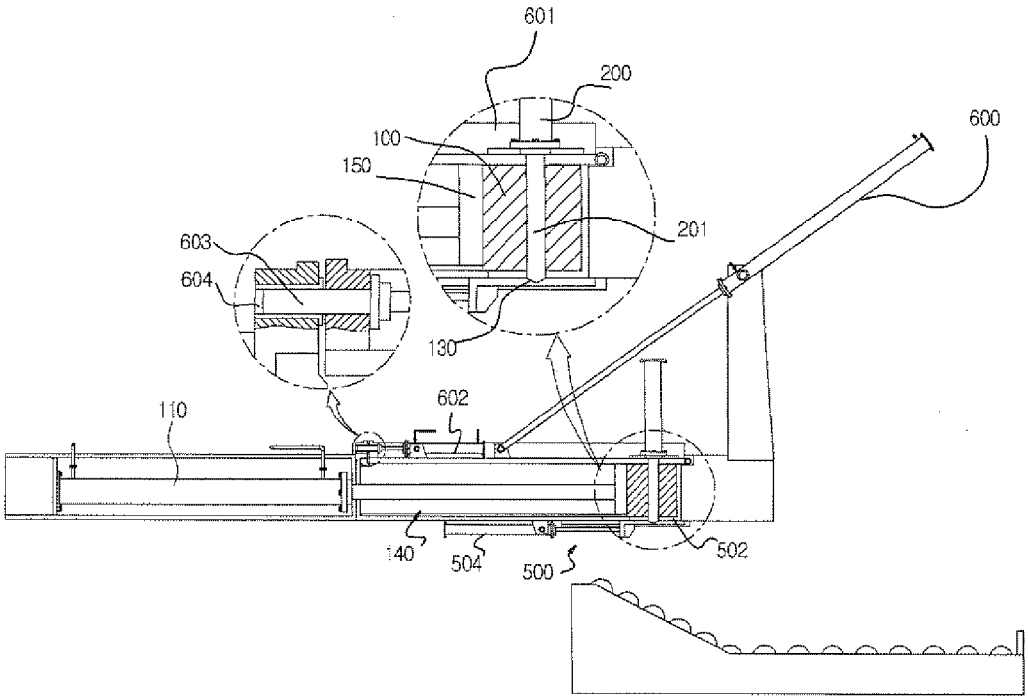
FIG. 19 is a longitudinal sectional view of a principal part of the apparatus for manufacturing the compressed lump of metal scrap according to the present invention shown in FIG. 18 showing a state in which cores are positioned at portions of a compressed lump of metal scrap at which through holes are to be formed as the result of secondary compression performed by the secondary compression cylinders.

After location of the core 201 to form the through hole 101 in the compressed lump 100 of metal scrap has been completed as described above, primary and secondary compression is carried out through the above process to compress the metal scrap so that the metal scrap has a target density. As a result, the core 201 of the core cylinder 200 fixed to the cover 601 is located in the through hole 101 of the compressed lump 100 of metal scrap as shown in FIG. 19.

Figure 20:
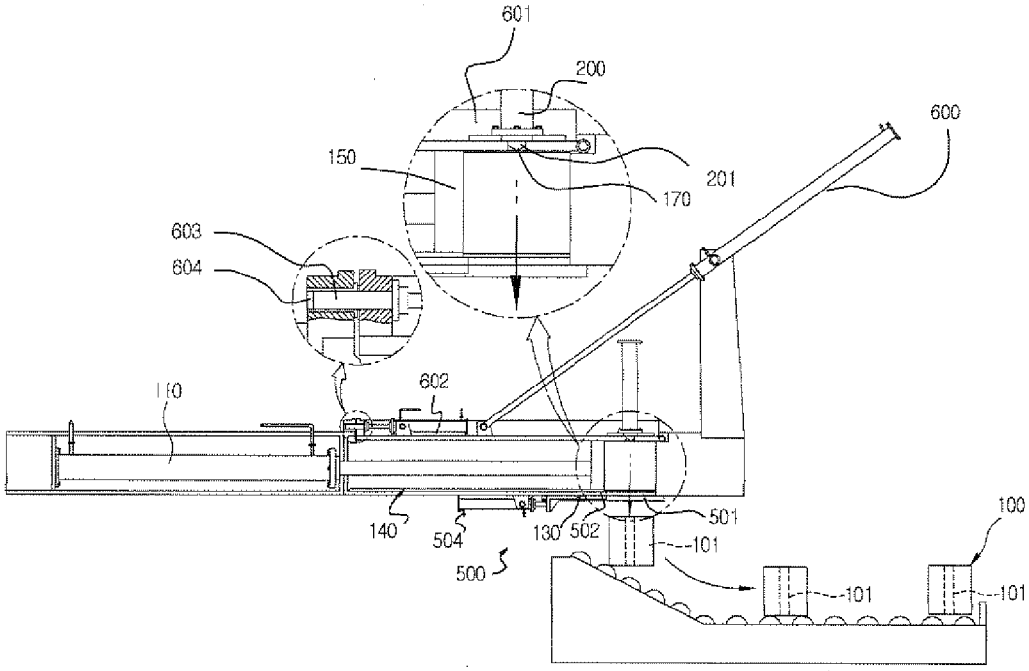
FIG. 20 is a side view showing discharge of metal scrap compressed according to the embodiment shown in FIG. 18 through a discharge port.

In this state, the core cylinder 200 is driven to move the core 201 upward as shown in FIG. 20. As a result, the core 201 is separated from the through hole 101 of the compressed lump 100 of metal scrap. Subsequently, the hydraulic cylinder 504 of the opening and closing unit 500 is driven to reciprocate the discharge plate 502 along the guide groove 503 with the result that the discharge port 501 is opened.

Consequently, the compressed lump 100 of metal scrap, which is a weight body, falls and is discharged through the discharge port 501.

Figure 21:
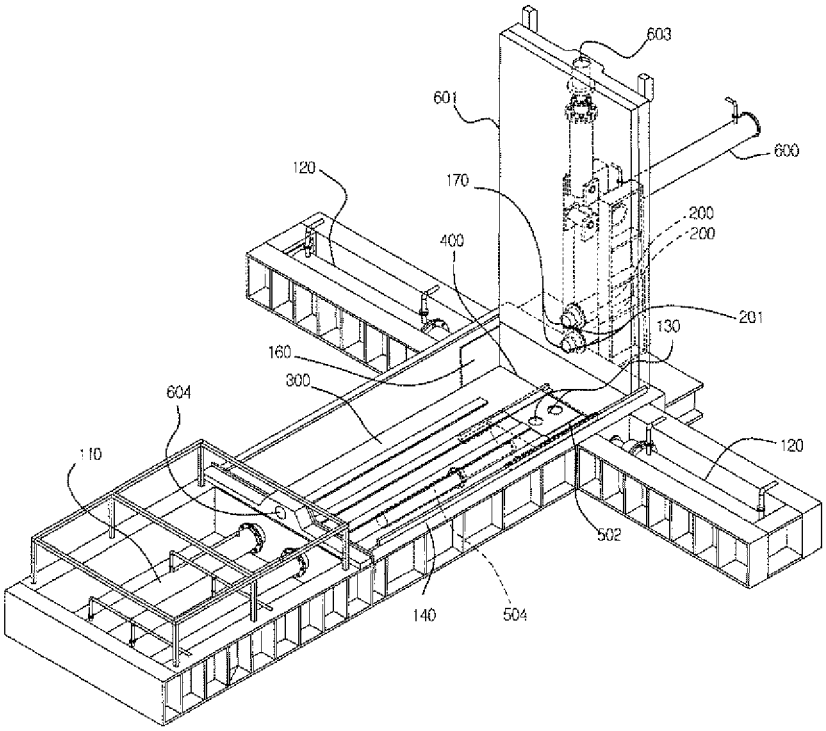
FIG. 21 is a perspective view showing another embodiment in which two core cylinders are installed at the cover in the apparatus for manufacturing the compressed lump of metal scrap according to the present invention.

In the above embodiment, the core 201 and the core cylinder 200 are installed at the cover 601 instead of the discharge plate 502, and the core tip receiving groove 130 is formed at the discharge plate 502 as shown in FIG. 18. In another embodiment, on the other hand, a plurality of cores 201 and a plurality of core cylinders 200 may be installed at the cover 601, and a plurality of core tip receiving grooves 130 may be formed at the discharge plate 502, as shown in FIG. 21, to form a plurality of through holes 101 in the compressed lump 100 of metal scrap. That is, in this embodiment, the cover 601 is opened to open the compression chamber 140, metal scrap is charged into the compression chamber 140, the cover 601 is closed, and the core cylinders 200 are driven to move the cores 201 downward. At this time, the tips 170 of the respective cores 201 are engaged in the core tip receiving grooves 130 formed at the discharge plate 502 with the result that the cores 201 are stably fixed.

Figure 22:
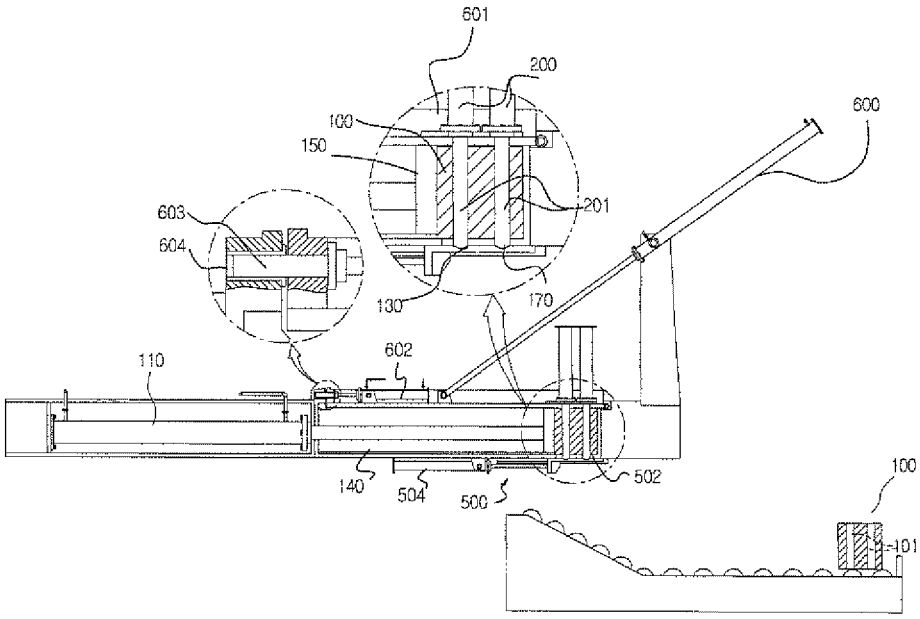
FIG. 22 is a side sectional view of a principal part of the apparatus for manufacturing the compressed lump of metal scrap according to the present invention showing a state in which cores are positioned in through holes of the compressed lump of metal scrap after primary and secondary compression have been completed according to the embodiment shown in FIG. 21.

After location of the cores 201 to form the through holes 101 in the compressed lump 100 of metal scrap has been completed as described above, primary and secondary compression is carried out through the above process to compress the metal scrap so that the metal scrap has a target density. As a result, the through holes 101 are formed in the compressed lump 100 of metal scrap by the cores 201 of the core cylinders 200 fixed to the cover 601 as shown in FIG. 22.

Figure 23:
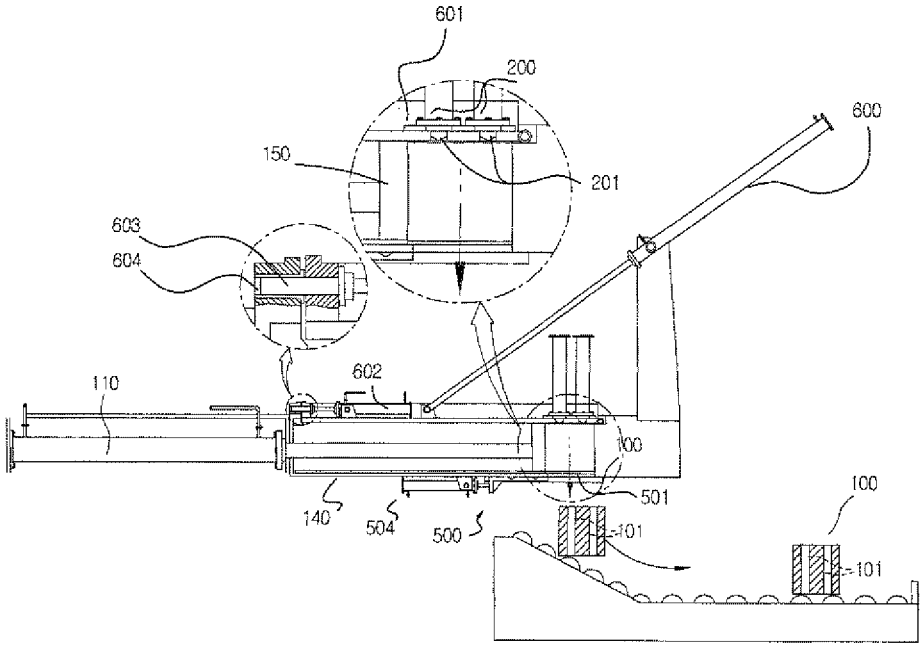
FIG. 23 is a side view showing discharge of a compressed lump of metal scrap, two through holes of which have been formed according to the embodiment shown in FIG. 21.

In this state, the core cylinders 200 are driven to move the cores 201 upward as shown in FIG. 23. As a result, the cores 201 are separated from the through holes 101 of the compressed lump 100 of metal scrap. Subsequently, the hydraulic cylinder 504 of the opening and closing unit 500 is driven to reciprocate the discharge plate 502 along the guide groove 503 with the result that the discharge port 501 is opened. Consequently, the compressed lump 100 of metal scrap, which is a weight body, falls and is discharged through the discharge port 501.

In the present invention as described above, the core 201 is located at the portion of the compression chamber at which the through hole 101 is to be formed in the compressed lump of metal scrap before the metal scrap is compressed under high pressure. Consequently, it is possible to form the through hole 101 in the compressed lump 100 of metal scrap, which is compressed with high density and thus cannot be processed except melting, while load is not applied to the core 201 and the relevant components.

In case of punching or drilling the compressed lump 100 of metal scrap using a drilling machine to form the through hole 101 in the compressed lump 100 of metal scrap, as can be commonly thought by those skilled in the art to which the present invention pertains, needs massive equipment, and high-priced materials for punching or drilling are frequently damaged or consumed.

In case of forming the through hole according to the present invention, on the other hand, the core is located at the portion of the compression chamber at which the through hole is to be formed in the compressed lump of metal scrap before the metal scrap is compressed under high pressure. Consequently, massive equipment is not needed, and high-priced materials for punching or drilling are not damaged or consumed, thereby greatly improving economy and operation efficiency.

Meanwhile, in the present invention, the discharge plate 502 is installed in the middle of the secondary compression space 400, and the opening and closing unit 500 using the hydraulic cylinder 504 to reciprocate the discharge plate 502 is disposed under the discharge plate 502. Of course, however, various kinds of well-known opening and closing devices may be selectively applied as needed.

Hereinafter, a method of manufacturing a compressed lump of metal scrap according to the present invention will be described with the accompanying drawings.

The method of manufacturing the compressed lump of metal scrap according to the present invention includes a step of charging metal scrap into the compression chamber 140, a step of performing a locking operation to close the cover 601 using the cover cylinder 600 and to drive the locking cylinder 602 so that the piston 603 extends to be fitted into the locking hole 604, a primary compression step of primarily compressing the metal scrap charged in the compression chamber 140 using the primary compression cylinders 110, a secondary compression step of secondarily compressing the primarily compressed metal scrap using the secondary compression cylinders 120, a discharge step of discharging a compressed lump 100 of metal scrap, compressed with target density through the secondary compression, through the discharge port, and a step of opening the cover 601 according to the operation of the cover cylinder 600 so that metal scrap can be charged into the compression chamber 140 again, the above steps being repeatedly carried out to repeatedly compress metal scrap, wherein the method of manufacturing the compressed lump of metal scrap according to the present invention further includes a space occupation step of vertically erecting the core 201 at the middle of the secondary compression space 400 so that the core 201 is located at a portion of the compression chamber at which a through hole is to be formed in the compressed lump of metal scrap before the primary compression step is carried out, a through hole forming step of maintaining the region of the secondary compression space occupied by the core 201 to form a through hole 101 in the compressed lump 100 of metal scrap while performing secondary compression using the secondary compression cylinders 120 after the primary compression is completed, and a core retreating step of separating the core 201 from the through hole to discharge the compressed lump 100 of metal scrap, compressed with target density, after the through hole 101 is formed in the compressed lump 100 of metal scrap.

Also, in realizing the method of manufacturing the compressed lump of metal scrap as described above, the core cylinder 200 to form the through hole 101 may be installed at the middle of the discharge plate 502, which is opened and closed by the hydraulic cylinder 504 of the opening and closing unit 500 to open and close the discharge port 501, as shown in FIGS. 5 to 14. Hereinafter, a method of manufacturing a compressed lump of metal scrap through the above-stated construction will be described in more detail.

Figure 12:
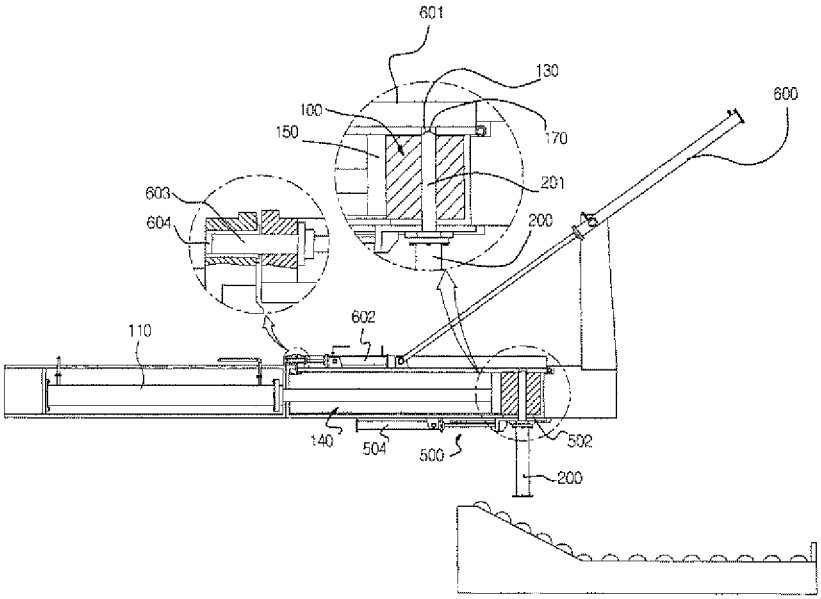
FIG. 12 is a longitudinal sectional view showing a state in which a core is positioned in a through hole of the compressed lump of metal scrap after primary and secondary compression has been completed in the apparatus for manufacturing the compressed lump of metal scrap according to the present invention.

The method of manufacturing the compressed lump of metal scrap according to the present invention includes a step of charging metal scrap into the primary compression space 300 and the secondary compression space 400 of the compression chamber 140 and a step of performing a locking operation to close the cover 601 using the cover cylinder 600 and to drive the locking cylinder 602 so that the piston 603 extends to be fitted into the locking hole 604, as shown in FIG. 9, a primary compression step of primarily compressing the metal scrap charged in the compression chamber 140 using the primary compression cylinders 110, as shown in FIG. 10, a secondary compression step of secondarily compressing the primarily compressed metal scrap using the secondary compression cylinders 120, as shown in FIGS. 11 and 12, and a discharge step of discharging a compressed lump of metal scrap, compressed with target density through the secondary compression, through the discharge port and a step of opening the cover according to an opening operation of the cover cylinder 600 so that metal scrap can be charged into the compression chamber 140 again, as shown in FIGS. 13 and 14, the above steps being repeatedly carried out to repeatedly compress metal scrap, wherein the method of manufacturing the compressed lump of metal scrap according to the present invention further includes a space occupation step of upwardly extending the core 201 using the core cylinder 200 installed at the middle of the discharge plate 502 to close the discharge port 501 so that the core 201 is located at the middle of the secondary compression space 400 before the step of charging the metal scrap into the compression chamber 140 and the step of closing the cover 601 are carried out, an occupied space maintaining step of maintaining the middle of the secondary compression space occupied by the core 201 at the primary and secondary compression steps, a through hole forming step of maintaining the region of the secondary compression space occupied by the core 201 to form a through hole 101 in the compressed lump 100 of metal scrap after primary and secondary compression is completed, and a core retreating step of downwardly moving the core 201 to a position lower than the height of the discharge plate 502 using the core cylinder 200 so that the core 201 is separated from the compressed lump 100 of metal scrap to discharge the compressed lump 100 of metal scrap, compressed with target density, after the through hole 101 is formed in the compressed lump 100 of metal scrap. Also, a method of manufacturing the compressed lump of metal scrap according to another embodiment of the present invention may include a space occupation step of downwardly extending the core 201 using the core cylinder 200 so that the core 201 is located at the middle of the secondary compression space 400 before or after closing the cover 610 at which the core cylinder 200 is installed, an occupied space maintaining step of maintaining the middle of the secondary compression space occupied by the core 201 at the primary and secondary compression steps, a through hole forming step of maintaining the region of the secondary compression space occupied by the core 201 to form a through hole 101 in the compressed lump 100 of metal scrap after primary and secondary compression is completed, and a core retreating step of upwardly moving the core 201 to a position higher than the bottom of the cover 601 using the core cylinder 200 so that the core 201 is separated from the compressed lump 100 of metal scrap to discharge the compressed lump 100 of metal scrap, compressed with target density, after the through hole 101 is formed in the compressed lump 100 of metal scrap. Meanwhile, in the embodiment in which the core 201 is upwardly moved so that the core 201 can be placed at a higher position than the discharge plate 502 during the manufacturing process according to the present invention, the tip of the core 201 is fitted in the core tip receiving groove 130 formed at the bottom of the cover 601, and in the embodiment in which the core 201 is downwardly moved so that the core 201 can be placed at a lower position than the cover 601 during the manufacturing process according to the present invention, the tip of the core 201 is fitted in the core tip receiving groove 130 formed at the middle of the discharge plate 502. As a result, the core 201 is securely and stably fixed, and therefore, it is possible to efficiently bear friction between the core 201 and the metal scrap or stress applied to the core 201 during primary and secondary compression, thereby minimizing wear of the core or damage to the core.

Also, in the present invention, a plurality of through holes may be formed so that the compressed lump of metal scrap can be more easily melted when the compressed lump of metal scrap is introduced into a blast furnace. To this end, a plurality of core cylinders 200 may be installed at the discharge plate 502 as shown in FIGS. 15 to 17, or a plurality of core cylinders 200 may be installed at the cover 601 as shown in FIGS. 21 to 23. In each case, a plurality of core tip receiving grooves 130 is formed at the bottom of the cover 601 or the top of the discharge plate 502.

Furthermore, in the present invention, well-known elements may be added or changed based on kinds of metal scrap or conditions of a manufacturing field where the apparatus for manufacturing the compressed lump of metal scrap is installed. Also, the technical characteristics of the present invention are not limited to the above-described embodiments and may be variously changed within the gist and concept intended by the present invention.

As apparent from the above description, a compressed lump of metal scrap manufactured according to the present invention has one or more through holes. When the compressed lump of metal scrap is introduced into a blast furnace, therefore, molten metal can infiltrate into the middle of the compressed lump of metal scrap through the through holes as well as the circumference of the compressed lump of metal scrap. Consequently, it is possible to rapidly melt the compressed lump of metal scrap at a speed equivalent to the speed at which a small-sized compressed lump of metal scrap is melted, thereby greatly reducing energy necessary to manufacture steel products.

Also, in the manufacturing apparatus according to the present invention, the metal scrap is primarily compressed around the core during the low-density compression process of primarily compressing the metal scrap charged in the compression chamber, and the metal scrap is secondarily compressed through the high-density compression process with the result that the through hole is formed in the compressed lump of metal scrap. Consequently, it is possible to minimize friction between the core and the metal scrap and stress applied to the core during the compression processes.

Particularly, in the present invention, the length of the core extending in the compression chamber to form the through hole in the compressed lump of metal scrap is configured to be equivalent to the length of the actual through hole of the compressed lump of metal scrap. Consequently, the length of the core is minimized, and therefore, bending stress applied to the core due to density deviation of the metal scrap during primary and secondary compression is minimized. Furthermore, since the length of the core is short, the deformation of the core is minimized, and therefore, durability of the core is greatly improved, thereby achieving stable operation of the core and increasing lifespan of the core.

In addition, in the present invention, metal scrap is charged into the compression chamber in a state in which the core is vertically erected in the compression chamber, and then primary and secondary compression is carried out. Consequently, the metal scrap is prevented from wedging into the core, the cover and the bottom of the compression chamber irrespective of shapes or kinds of the metal scrap, thereby achieving smooth operation.

What is claimed is:

1. An apparatus for manufacturing a compressed lump of metal scrap configured to compress metal scrap by a primary press plate reciprocated in a primary compression space of a compression chamber, which is opened and closed by a cover and a cover cylinder so that metal scrap is charged into the compression chamber, by a primary compression cylinder and secondary press plates reciprocated in opposite sides of a secondary compression space of the compression chamber by secondary compression cylinders and to discharge the compressed lump of metal scrap through a discharge port, wherein the primary press plate and primary compression space and the secondary press plate and secondary compression space are vertically aligned such that, a direction in which compression is performed by the primary press plate is perpendicular to a direction in which compression is performed by the secondary press plate, and the apparatus comprises:

a core installed at the middle of the secondary compression space in an erected state so that the core is perpendicular to the direction in which compression is performed by the primary press plate and the direction in which compression is performed by the secondary press plate;

a core cylinder for reciprocating the core to form a through hole in a compressed lump of metal scrap, the core cylinder and the core are provided on a discharge plate; and an opening and closing unit for reciprocating the discharge plate along a guide groove to open and close the discharge plate relative to the discharge port.

2. An apparatus for manufacturing a compressed lump of metal scrap configured to compress metal scrap by a primary press plate reciprocated in a primary compression space of a compression chamber, which is opened and closed by a cover and a cover cylinder so that metal scrap is charged into the compression chamber, by a primary compression cylinder and secondary press plates reciprocated in opposite sides of a secondary compression space of the compression chamber by secondary compression cylinders and to discharge the compressed lump of metal scrap through a discharge port, wherein a direction in which compression is performed by the primary press plate is perpendicular to a direction in which compression is performed by the secondary press plate such that the primary press plate and the secondary press plate are coplanar and the apparatus comprises:

a core installed at the middle of the secondary compression space in an erected state so that the core is perpendicular to the direction in which compression is performed by the primary press plate and the direction in which compression is performed by the secondary press plate;

a core cylinder and the core are provided on a discharge plate and the core cylinder is configured to reciprocate the core to form a through hole in a compressed lump of metal scrap, the core cylinder and the core are being installed at the bottom of the discharge plate so that the core can be retreated to a position lower than the height of the discharge plate or so that the core can be extended to a position equivalent to the height at which the core can come into contact with the bottom of the cover; and an opening and closing unit for reciprocating the discharge plate to open and close the discharge plate relative to a discharge port.

3. An apparatus for manufacturing a compressed lump of metal scrap configured to compress metal scrap by a primary press plate reciprocated in a primary compression space of a compression chamber, which is opened and closed by a cover and a cover cylinder so that metal scrap is charged into the compression chamber, by a primary compression cylinder and secondary press plates reciprocated in opposite sides of a secondary compression space of the compression chamber by secondary compression cylinders and to discharge the compressed lump of metal scrap through a discharge port, wherein the primary press plate and primary compression space and the secondary press plate and secondary compression space are vertically aligned such that, a direction in which compression is performed by the primary press plate is perpendicular to a direction in which compression is performed by the secondary press plate, and the apparatus comprises:

a core installed at the middle of the secondary compression space in an erected state so that the core is perpendicular to the direction in which compression is performed by the primary press plate and the direction in which compression is performed by the secondary press plate;

a core cylinder provided on the cover for reciprocating the core to form a through hole in a compressed lump of metal scrap, the core cylinder and the core being installed at the cover so that the core can be retreated to a position higher than the bottom of the cover or so that the core can be downwardly extended to a position equivalent to the length at which the core can come into contact with a discharge plate; and an opening and closing unit for reciprocating the discharge plate to open and close the discharge plate relative to the discharge port to permit removal of compressed metal.

4. The apparatus according to claim 1, wherein the core has a tip, and a core tip receiving groove is formed at a corresponding surface coming into contact with the core when the core is extended.

5. The apparatus according to claim 2, wherein a core tip receiving groove is formed at the bottom of the cover with which a tip of the core comes into contact.

6. The apparatus according to claim 3, wherein a core tip receiving groove is formed at the discharge plate with which a tip of the core comes into contact.

7. The apparatus according to claim 5, wherein the core comprises a plurality of cores, the core cylinder comprises a plurality of core cylinders, and the core tip receiving groove comprises a plurality of core tip receiving grooves.

8. The apparatus according to claim 6, wherein the core comprises a plurality of cores, the core cylinder comprises a plurality of core cylinders, and the core tip receiving groove comprises a plurality of core tip receiving grooves.

9. The apparatus of claim 1, wherein the core cylinder is installed on a bottom side of the discharge plate.

10. The apparatus of claim 9, wherein the core cylinder is installed at a middle of the bottom side of the discharge plate.

11. The apparatus of claim 1, wherein the opening and closing unit is driven to reciprocate the discharge plate along the guide groove.

12. The apparatus of claim 2, wherein the core cylinder is installed on a bottom side of the discharge plate.

13. The apparatus of claim 12, wherein the core cylinder is installed at a middle of the bottom side of the discharge plate.

14. The apparatus of claim 2, wherein the opening and closing unit is driven to reciprocate the discharge plate along a guide groove.

15. The apparatus of claim 3, wherein the core cylinder is installed on a top side of the cover.

16. The apparatus of claim 15, wherein the core cylinder is installed at a middle of the a top side of the cover.

17. The apparatus of claim 3, wherein the opening and closing unit is driven to reciprocate the discharge plate along a guide groove.

* * * * *